US009451681B2

(12) United States Patent
Lindsay et al.

(10) Patent No.: US 9,451,681 B2
(45) Date of Patent: Sep. 20, 2016

(54) FEEDBACK CIRCUIT FOR A DISPLAY SIGN AND METHOD

(75) Inventors: Charles Lee Lindsay, Monument, CO (US); Charles Hunter Bush, Colorado Springs, CO (US)

(73) Assignee: Skyline Products, Inc., Colorado Springs, CO (US)

( * ) Notice: Subject to any disclaimer, the term of this patent is extended or adjusted under 35 U.S.C. 154(b) by 905 days.

(21) Appl. No.: 12/540,538

(22) Filed: Aug. 13, 2009

(65) Prior Publication Data

US 2011/0037604 A1 Feb. 17, 2011

Related U.S. Application Data

(62) Division of application No. 11/274,647, filed on Nov. 15, 2005, now Pat. No. 7,602,305.

(51) Int. Cl.

| | |
|---|---|
| ***G08B 21/00*** | (2006.01) |
| ***G08B 5/22*** | (2006.01) |
| ***H05B 37/03*** | (2006.01) |

(52) U.S. Cl.
CPC ..... *H05B 37/03* (2013.01)

(58) Field of Classification Search
USPC ..... 340/642, 641, 657, 661, 815.45, 635, 340/654, 664, 815.4, 815.42, 815.52; 315/129–136; 362/800, 812; 324/76.79; 345/1.1, 2.1, 4, 44, 46, 82
See application file for complete search history.

(56) References Cited

U.S. PATENT DOCUMENTS

| | | | | |
|---|---|---|---|---|
| 5,457,450 | A * | 10/1995 | Deese et al. | 340/912 |
| 5,717,335 | A * | 2/1998 | Lee | 324/414 |
| 6,157,296 | A * | 12/2000 | Endoh | 340/458 |
| 6,320,330 | B1 * | 11/2001 | Haavisto et al. | 315/291 |
| 6,583,731 | B2 * | 6/2003 | Chan et al. | 340/931 |
| 7,250,872 | B2 * | 7/2007 | Klinger | 340/642 |
| 7,623,028 | B2 * | 11/2009 | Kates | 340/521 |

* cited by examiner

*Primary Examiner* — Anh V La
(74) *Attorney, Agent, or Firm* — Bryan Cave LLP

(57) ABSTRACT

A feedback circuit for a display sign has a number of lights. A resistor is coupled in series with the lights. A voltage measuring circuit is coupled to the resistor.

5 Claims, 5 Drawing Sheets

FEEDBACK CIRCUIT FOR A DISPLAY SIGN AND METHOD

RELATED APPLICATIONS

None

FIELD OF THE INVENTION

This application is a divisional application of U.S. application Ser. No. 11/274,647, entitled "Feedback Circuit for Display Sign and Method," filed on Nov. 15, 2005.

BACKGROUND OF THE INVENTION

Outdoor signs started out as static signs. The accuracy of these signs was checked before the sign was mounted. However, some industries and government entities found it desirable to have signs that could be easily changed. For instance, retail gasoline stores generally display the price they are charging for various grades of gasoline. One solution is a sign that has manually placed characters that fit is certain slots on the sign. These signs are verified by the person placing the characters, however it is common for the characters to be blown off or fall down and the sign be incorrect. A more advanced sign is a variable message sign that has lights that may be controlled to make a display. These signs are used by retail outlets, banks, highway departments, sporting arenas and others. These signs are much more convenient to use. However, when the lights are not working it is possible for the sign to be illegible or even incorrect. This can led to irate customers or in the case of highway signs misdirected drivers.

Thus there exists a need for a feedback circuit for display signs that allows the user to remotely monitor the legibility of variable message signs.

SUMMARY OF INVENTION

A feedback circuit for a display sign that overcomes these and other problems has a number of lights. A resistor is coupled in series with the lights. A voltage measuring circuit is coupled to the resistor. The lights may be arranged in a number of strings of lights. The strings of lights may be electrically connected in parallel. The voltage measuring circuit may include a comparator having a first input coupled to a node of the resistor and a second input coupled to a reference voltage. A digital to analog converter having an input may be coupled to the microcontroller and have an output coupled to the second input of the comparator.

In one embodiment, a method of determining if a display sign is operating properly includes the steps of determining an electrical characteristic of a number of lights. Next, the electrical characteristic is compared to a reference. When the electrical characteristic is less than the reference, one of the lights is inoperative. The reference may first be calibrated. Calibrating the reference includes setting a starting reference. The starting reference is compared to the electrical characteristic. When the starting reference differs more than a predetermined amount, the starting reference is adjusted. The lights may be arranged into a number of strings. The strings may be connected in parallel electrically. A switch may be connected in series with the lights.

In one embodiment, a feedback circuit for a display sign has a number of lights. A comparator having a first input is coupled to a node of the lights and a second input of the comparator is coupled to a reference. The lights are coupled together in a number of strings. The strings may be coupled together in parallel electrically. A digital to analog converter may have an input coupled to the microcontroller. The output of the digital to analog converter may be coupled to the second input of the comparator. A switch may be coupled between the node of the lights and the first input of the comparator.

DETAILED DESCRIPTION OF THE DRAWINGS

The present invention is directed to solving the need for feedback in a variable message sign and may be used with any remotely controlled sign. If an owner changes a variable message sign remotely, he has no way of knowing if the sign is operating correctly. If lights are out on the variable message sign, the message may be illegible or misleading. The present invention provides a method of determining if the lights of a variable message are operating correctly. Note that the invention is described with respect to a specific remote controlled sign system, but is not limited to this system.

Figure 1:
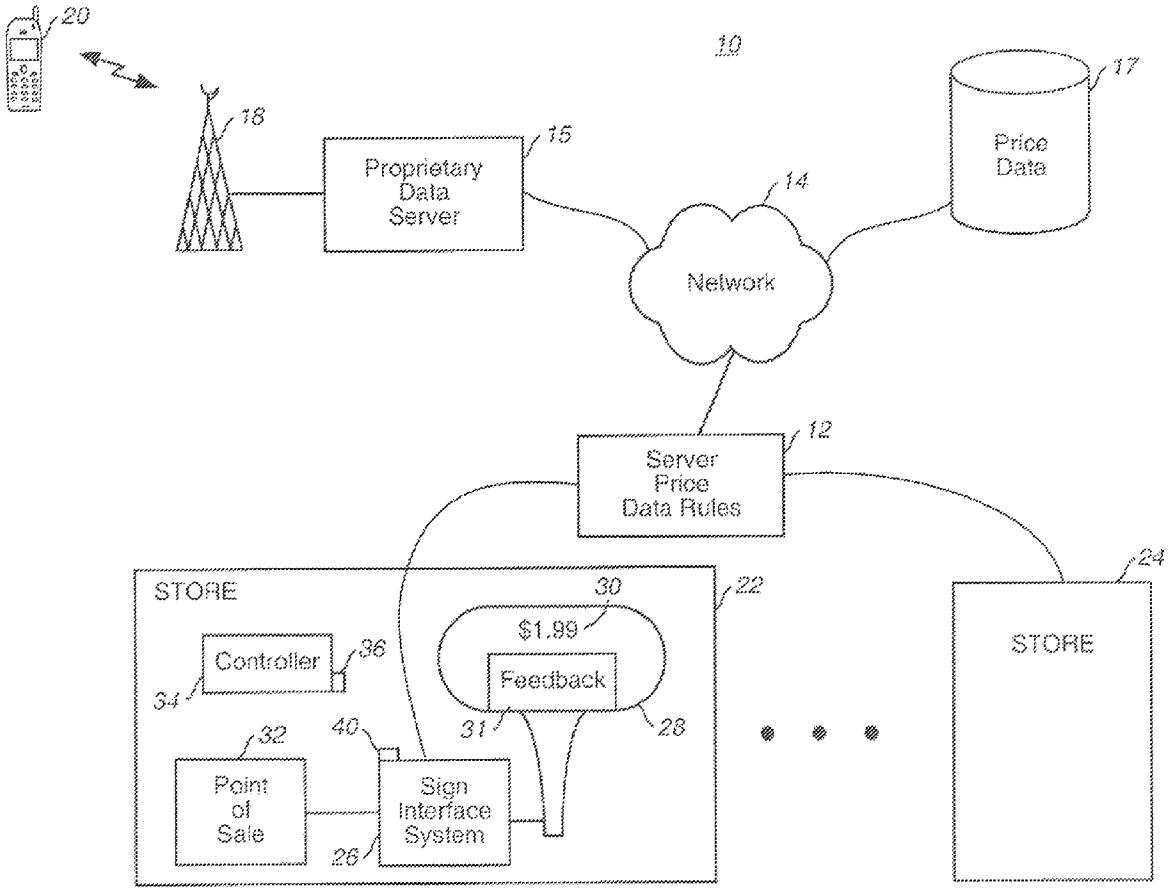
FIG. 1 is a block diagram of a system for controlling outdoor signs in accordance with one embodiment of the invention.

FIG. 1 is a block diagram of a system 10 for controlling outdoor signs in accordance with one embodiment of the invention. The system 10 has a store server 12 that stores competitive price data and has price rules and algorithms. The store serve 12 is connected through a network 14 to a proprietary data server 15. The proprietary server 15 is connected to one or more commercial price data services 17 through the network 16. The network 16 may be the internet but may be any other communication network. The proprietary server 14 is coupled to a wireless network 18 which couples the server 15 to a cellular telephone 20 or other wireless communication device.

The store server 12 is coupled to a plurality of stores 22, 24. In one embodiment, the server 12 may connect to the stores 22, 24 through the network 14. Each store has a sign interface system 26 coupled to a controllable sign 28. Note that the controllable sign 28 has a controllable display price 30. The controllable sign 28 has a feedback system 31. The sign interface system 26 is coupled to a point of sale system 32. A handheld controller 34 has an interface 36 that allows it to coupled to an interface 40 on the sign interface system 26. The interface 36 may be a physical connection or it may be wireless connection. In addition, the handheld controller may be replaced with a touch-screen display that is coupled to the sign interface system 26. The store 24 is setup similarly to store 22.

The operation of the system 10 will be explained with respect to a retail gas company that has multiple retail outlets. As explained above, most of the profits of a retail gas company are made when customers buy the high margin items in the store. The gasoline is mainly used to induce customers to visit the store. If the company prices their gasoline too high then fewer customers stop to get gas and purchase the high margin items in the store. On the other hand the store cannot afford to price the gasoline so low that they are losing money on the sale of gasoline. As a result, it is important for the retail gas company to know the price competitors are charging for gasoline. One method of collecting this data is from commercial gasoline price databases shown as element 17. There are a number of such services. In addition, the service 17 may include data on other price factors such as the spot price for crude oil, gasoline inventory levels, weather issues that may effect delivery, etc. While these services 17 are helpful, the retail gas company may also need to factor in the price of retail outlets within a short distance of each of their stores. A store employee can collect local competitors' price of gasoline using the handheld controller 34. The information can then be uploaded to the store server 12 and from there to the proprietary data server 15. Note that there may a separate proprietary server 15 for each retail gas company or the server 15 may be segmented and protected with various encryption and password systems so that a single server 15 may serve multiple retail gas companies. The server 15 may also store fuel price, volume and margin information for stores. This information alternatively may be stored in the store server 12.

Once the retail gas company has the necessary data to determine the price of gasoline they want to charge at each of their stores, then they need to process the data. The server 12 has a number of preprogrammed algorithms for setting the price of gasoline once the appropriate data has been collected. For instance, one simple price rule is our price will be one cent per gallon of gasoline less than the nearest competitor. Note for a multiple store company this means that each store 22, 24 may have a different price. Another preprogrammed algorithm is to set a price of gasoline that is in the average for the surrounding area. The server 12 also has a wizard so that more complex pricing algorithms may be setup by the retail gas company. For instance, the wizard may change the price based on the weather or time of day or may alert the retail gas company's pricing manager if the price is below the company's cost. The wizard will allow the company to set the price based on historical traffic patterns or historical traffic patterns and weather and competitor's prices. The wizard makes it easy for a non-programmer to setup these pricing rules and change them if they are not suiting the retail gas company's needs.

Once the price of gasoline is determined the individual stores 22, 24 need to implement the price change. In one embodiment, the server 12 notifies a retail price manager of the need to change the price. This may be accomplished by sending a message over a wireless network 18 to a portable device 20. The manager may then approve the price change and the new price is sent to the store(s) 22, 24. The price may be sent to the sign interface system 26 that then notifies the store manager via the point of sale system 32 to update the price. The store manager then approves the price and uses the controller to change price at the point of sale system 32. The point of sale system 32 then commands the sign interface system 26 to update the display price 30. The feedback system 31 next determines if the display price 30 is operative. Operative means that the display price 30 is legible and correct. If a problem exists with the display price 30, then this is communicated through the sign interface 26 to the server 12 and an alert message is sent over the wireless network 18 to the wireless phone 20. The alert message is also sent to the controller 34 or point of sale system 32. Having a controllable sign 28 instead of a manual sign is critical to making fast and effective decisions on the price of the gasoline. If the sign is manual the employees may not implement the change on time, they may make a mistake in the display price or the wind or other weather may cause the display price to be incorrect.

The sign interface system 26 allows the different types of point of sale systems 32 to communicate with different controllable signs 28. The feedback system 31 may be located in the sign interface 26. The sign interface system 26 may includes a dial-up or other modem to communicate with the server over the web or through the PSTN (Public Switched Telephone Network) or it may communicate with the server 12 wirelessly. In one embodiment, the handheld controller 34 communicates with the server 12 and the information is passed through the interface 36, 40 to the sign interface system 26. The point of sale system 32 is a standard piece of equipment that is used in all retail gas stores. In one embodiment, the server 12 is not connected to the wireless network 18 but the sign interface system 26 is connected to the wireless network 18. Clearly, the goals of the system 10 may be accomplished even if the connections between the components are changed.

In one embodiment, the server 12 sends the new gasoline price to the sign interface system 26 or controller 34 and the display price 30 and the price at the point of sale system 32 are automatically updated. An alert message may be sent to the retail gas company's price manager 20 that the price has been changed. The price change may be overruled by the manager and the price changed using the controller 34.

When the system 10 does not automatically change the price, the server 12 sends a notice containing the suggested price change to the retail price manager 20. The manager may then approve or deny the price change, which is implemented at the store 22, 24 using the controller 34. Clearly, the system 10 is very flexible and allows each retail gas company to tailor the system to meet their needs. The basic functions that the system allows the retail gas company are: 1) gathering pricing factors; 2) analyzing the price factors to determine a price; 3) controllably updating the price sign; and 4) feedback that the display price is operative.

Figure 2:
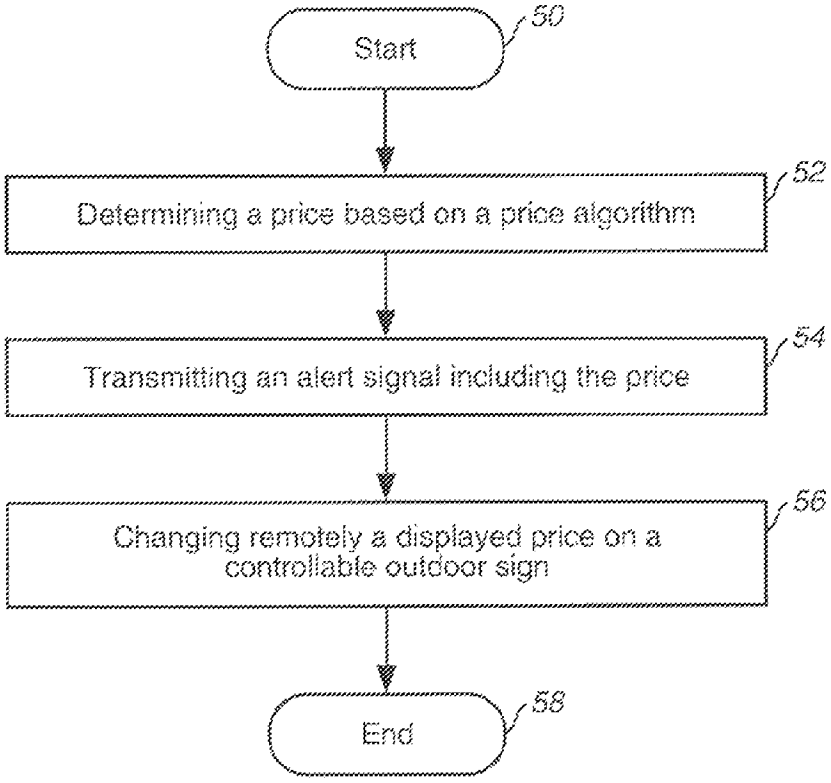
FIG. 2 is a flow chart of the steps in a method of operating a system for controlling outdoor signs in accordance with one embodiment of the invention.

FIG. 2 is a flow chart of the steps in a method of operating a system for controlling outdoor signs in accordance with one embodiment of the invention. The process starts, step 50, by determining a price based on a price algorithm at step 52. An alert signal is transmitted to a manager that includes the price at step 54. At step 56 the display price is changed remotely on the controllable outdoor sign which ends the process at step 58. The step of determining a price includes gather competitive prices and other price factors such as the spot price of oil. The price algorithm system includes a wizard that makes it easy for a user to create price rule that is tailored for the customer. The controllable sign includes a feedback system to determine if the price is legible and displaying the correct price.

Figure 3:
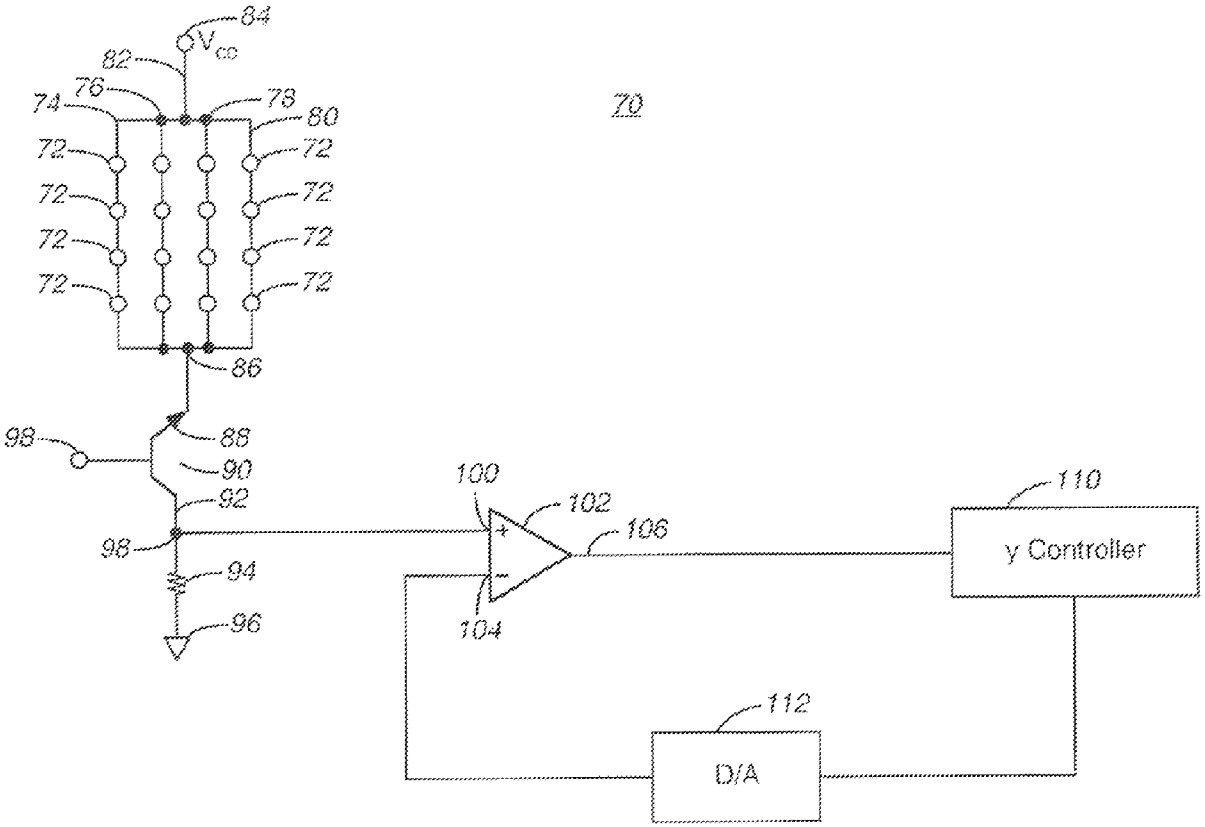
FIG. 3 is a block diagram of a feedback circuit for a display sign in accordance with one embodiment of the invention.

FIG. 3 is block diagram of a feedback circuit 70 for a display sign in accordance with one embodiment of the invention. The feedback circuit 70 has a plurality of lights 72. The lights 72 are arranged in four strings 74, 76, 78 & 80. Within each string of lights 74, 76, 78 & 80 the lights 72 are in series. The strings of lights 74, 76, 78 & 80 are in parallel. The lights may be any type of lights, however LEDs (light emitting diodes) are the most commonly used in the industry at this time. At a first node 82 the lights 72 are coupled to a power supply voltage Vcc 84. At a second node 86 the lights 72 are coupled to a drain 88 of a transistor 90. The transistor 90 is a controllable switch in the circuit. The source 92 of transistor 90 is coupled to a resistor 94. The other node of the resistor 94 is coupled to ground 96. The base 98 of transistor 90 is coupled to a controller which may be a sign controller that turns on or off a group of lights 72. A sign would normally be made up of several groups of lights, but only one is shown for clarity. The first node 98 of the resistor 94 is coupled to an input 100 of a comparator 102. The second input 104 of the comparator is coupled to a reference voltage. The output 106 of the comparator 102 is coupled to a microcontroller 110. The microcontroller 110 has an output that is coupled to a digital to analog converter (D/A) 112. The output of the digital to analog converter 112 is coupled to the reference input 104.

In operation, when the controller closes the switch 90, by applying a high signal to the base 98 of the transistor 90, the group of lights 72 draw current. If one of the lights 72 is out then one of the strings of lights 74, 76, 78 or 80 is not drawing current. As a result, the voltage across the resistor 94 will be less than if all the lights 72 were operable. The voltage at node 98 is compared to a reference voltage 104 by the comparator 102. In one embodiment, the reference voltage 104 is set to be equal to the voltage when all the lights 72 are operating. The difference in voltage when one or more strings of lights are not operating results is an output voltage from the comparator 102. The microcontroller 110 receives the difference voltage and determines that one, two or more strings of lights are inoperable. The microcontroller 110 may then send a message to the sign controller which may forward the message to the owner or operator of the sign. The information may included an indication that a problem exists, but no action is required immediately. Alternatively, the information may be that the sign is illegible and action must be taken immediately. In one embodiment, the microcontroller 110 may be connected to a communication network. The alerting message may be sent over this communication network.

The system 70 is self calibrating in one embodiment. When the sign is initially turned on, the switch 90 is closed. Note that the switch 90 may be a p-channel transistor or any other controllable switch. When the switch 90 is closed current flows through the lights 72 to the resistor 94 and to ground 96. The current flowing through the lights 72 is proportional to the number of strings 74, 76, 78 & 80 that are operating. The voltage at node 98 is directly related to the number of strings 74, 76, 78 & 80 operating. When the sign is initialized, the voltage 98 is compared to a preset reference at input 104. If the voltage at node 98 is higher (or lower) than the preset reference voltage, then the output 106 will be a positive (negative) voltage. The difference voltage is detected by the microcontroller 110. The microcontroller 110, then directs the digital to analog converter 112 to output a higher (lower) voltage at node 104, until the reference voltage is essentially equal to the voltage at node 98. Once the circuit is calibrated the microcontroller 110 stores the reference voltage and switches into operating mode. The calibration feature allows the circuit 70 to adjust to any number of strings of lights 74, 76, 78 & 80. Note that a string of lights may be single light or multiple lights.

Figure 4:
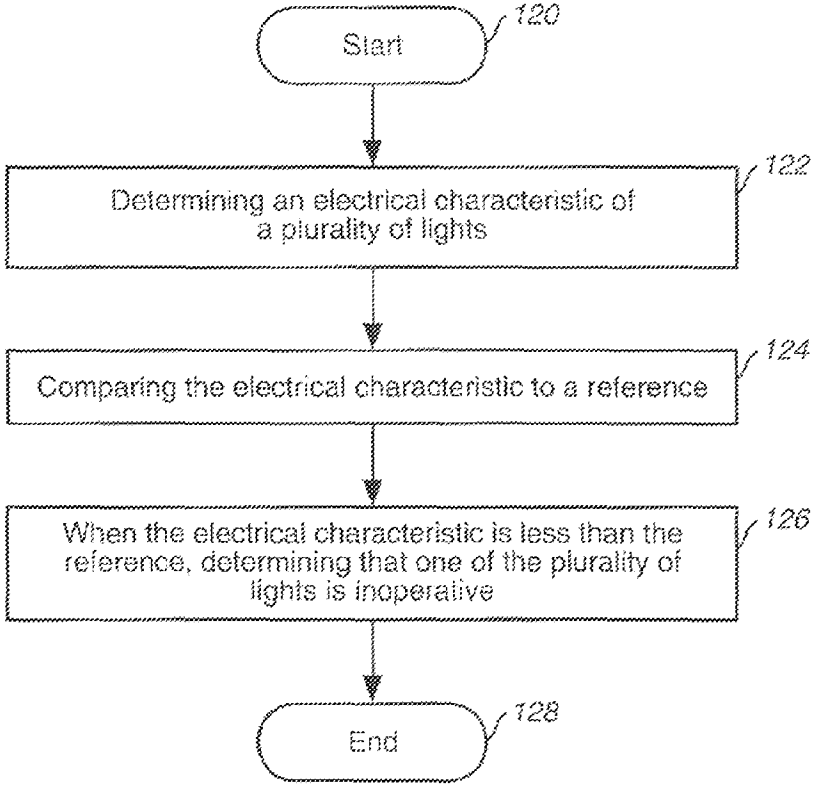
FIG. 4 is a flow chart of the steps used in a method of determining if a display sign is operating properly in accordance with one embodiment of the invention.

FIG. 4 is a flow chart of the steps used in a method of determining if a display sign is operating properly in accordance with one embodiment of the invention. The process starts, step 120, by determining an electrical characteristic of a plurality of lights 122. Note that the electrical characteristic could be voltage, current, power, etc. Next, the electrical characteristic is compared to a reference at step 124. When the electrical characteristic is less than the reference at step 126, it is determined that one of the plurality of lights is inoperative which ends the process at step 128.

Figure 5:
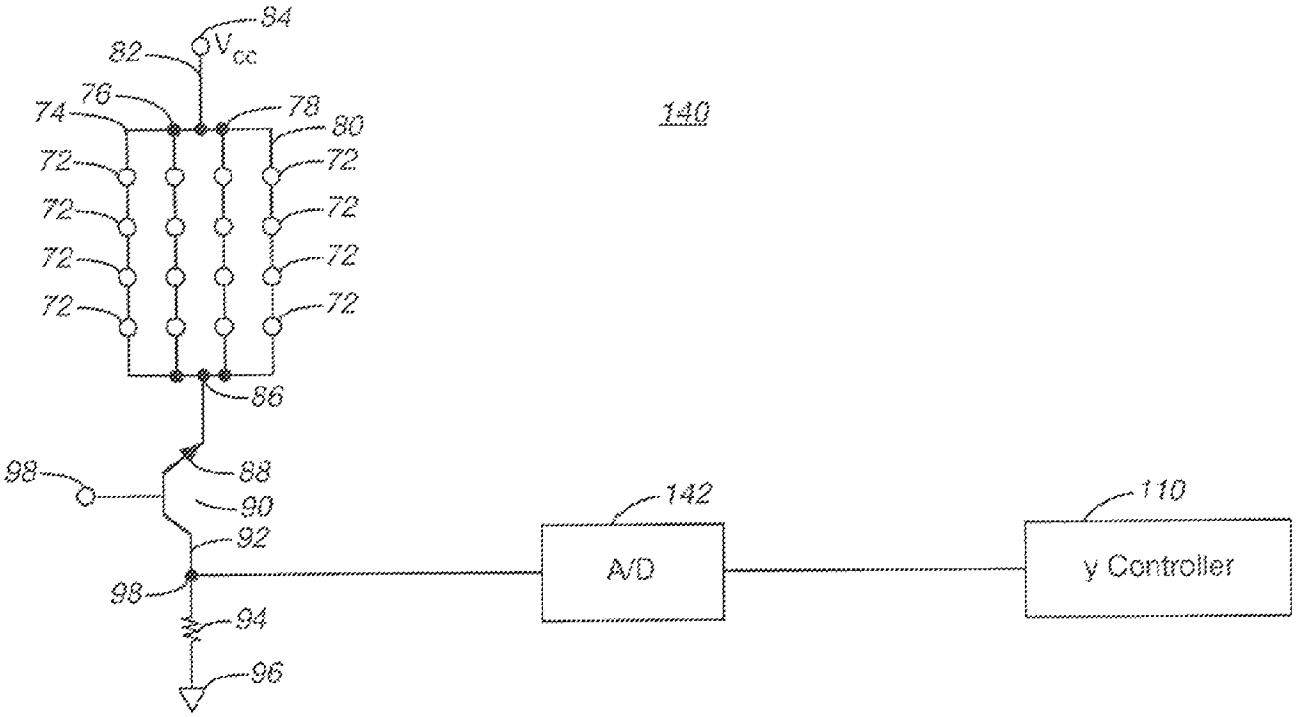
FIG. 5 is a block diagram of a feedback circuit for a display sign in accordance with one embodiment of the invention.

FIG. 5 is a block diagram of a feedback circuit 140 for a display sign in accordance with one embodiment of the invention. This feedback circuit 140 is very similar to the circuit 70 of FIG. 3, except that the comparator 102 and D/A 112 are replaced by an analog to digital converter (A/D) 142. The comparison type function is then performed in the microcontroller 110. If it is determined that any of the lights are not functioning, this information is communicated to the appropriate people to have the light(s) fixed.

Note that the feedback circuit may be easily used with signs that Pulse Width Modulation (PWM) to control the brightness of the sign. The sampling of the voltage at node 98 must be sampled when power (current) is applied to the lighting elements.

Thus there has been described a circuit and method that provides feedback that a lighted display sign is not operating correctly. The feedback circuit may be used with any remotely controlled sign.

Note that while the system has been described with respect to retail gas stores, the invention is broader than this specific implementation of the invention.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A method of determining if a display sign is operating properly, comprising the steps of:

a) applying a direct current to a plurality of lights, the plurality of lights arranged in strings of lights in parallel and each string having at least a pair of lights in series;

b) determining an electrical characteristic of the plurality of lights;

c) comparing the electrical characteristic to a reference; and d) transmitting a signal that indicating a number of strings of lights that are inoperable.

2. The method of claim 1, wherein step (c) further includes the step of:

C1) when the electrical characteristic is less than the reference, determining that one of the plurality of lights is inoperative.

3. The method of claim 1, wherein step (a) further includes the step of:

a1) calibrating the reference.

4. The method of claim 3, wherein step (a1) includes the step of:

i) setting a starting reference;

ii) comparing the starting reference to the electrical characteristic;

iii) when the starting reference differs more than a predetermined amount, adjusting the starting reference.

5. The method of claim 1, further including the step of: connecting a switch in series with the plurality of lights.

* * * * *